US009754538B2

(12) United States Patent
Lee et al.

(10) Patent No.: US 9,754,538 B2
(45) Date of Patent: Sep. 5, 2017

(54) METHOD OF DRIVING ORGANIC LIGHT EMITTING DISPLAY APPARATUS WITH A DEFECTIVE PIXEL

(71) Applicant: LG DISPLAY CO., LTD., Seoul (KR)

(72) Inventors: Yoon Ju Lee, Gangneung-si (KR); Soo Hong Choi, Paju-si (KR); Kwang Hun Jeon, Yeosui-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/792,054

(22) Filed: Jul. 6, 2015

(65) Prior Publication Data

US 2016/0005383 A1 Jan. 7, 2016

(30) Foreign Application Priority Data

Jul. 7, 2014 (KR) ..... 10-2014-0084546

(51) Int. Cl.
*G09G 3/30* (2006.01)
*G09G 3/3291* (2016.01)
*G09G 3/3208* (2016.01)

(52) U.S. Cl.
CPC ..... *G09G 3/3291* (2013.01); *G09G 3/3208* (2013.01); *G09G 2300/0814* (2013.01); *G09G 2300/0819* (2013.01); *G09G 2300/0842* (2013.01); *G09G 2320/029* (2013.01); *G09G 2330/08* (2013.01); *G09G 2330/10* (2013.01); *G09G 2330/12* (2013.01)

(58) Field of Classification Search
CPC ..... G09G 3/3291; G09G 3/3208; G09G 2300/0814; G09G 2300/0819; G09G 2330/12; G09G 2320/029; G09G 2330/08; G09G 2330/10; G09G 2300/0842
See application file for complete search history.

(56) References Cited

U.S. PATENT DOCUMENTS

| | | | | |
|---|---|---|---|---|
| 5,694,228 | A | 12/1997 | Peairs et al. | |
| 7,009,644 | B1 | 3/2006 | Sanchez et al. | |
| 2007/0120476 | A1 | 5/2007 | Park et al. | |
| 2007/0229420 | A1* | 10/2007 | Hwang | G09G 3/006 345/87 |
| 2009/0061720 | A1 | 3/2009 | Fujimaki | |
| 2014/0319486 | A1* | 10/2014 | Hong | G09G 3/32 257/40 |
| 2014/0354518 | A1* | 12/2014 | Park | G09G 3/3233 345/76 |
| 2015/0102312 | A1* | 4/2015 | Lee | G09G 3/3233 257/40 |
| 2015/0144904 | A1 | 5/2015 | Jeong et al. | |

FOREIGN PATENT DOCUMENTS

| | | | |
|---|---|---|---|
| CN | 1118484 | A | 3/1996 |
| CN | 1303071 | A | 7/2001 |
| CN | 1482797 | A | 3/2004 |
| KR | 100720142 | B1 | 5/2007 |
| KR | 10-2013-0143732 | A | 11/2015 |
| WO | 2004042413 | A1 | 5/2004 |

* cited by examiner

*Primary Examiner* — Kwang-Su Yang
(74) *Attorney, Agent, or Firm* — Dentons US LLP

(57) ABSTRACT

Disclosed is a method of driving an organic light emitting display apparatus which, when a defective pixel where at least one organic light emitting diode (OLED) is not normally driven occurs in a plurality of pixels each including two OLEDs, changes input image data corresponding to a data voltage to be supplied to the at least one OLED by using a compensation value.

9 Claims, 9 Drawing Sheets

METHOD OF DRIVING ORGANIC LIGHT EMITTING DISPLAY APPARATUS WITH A DEFECTIVE PIXEL

CROSS-REFERENCE TO RELATED APPLICATIONS

This application claims the benefit of the Korean Patent Application No. 10-2014-0084546 filed on Jul. 7, 2014, which is hereby incorporated by reference for all purposes as if fully set forth herein.

BACKGROUND

Field of the Invention

The present invention relates to a method of driving an organic light emitting display apparatus. More particularly, the invention relates to a method of driving an organic light emitting display apparatus including a panel where two organic light emitting diodes are provided in each of a plurality of pixels.

Discussion of the Related Art

As a type of flat panel display (FPD) apparatus, organic light emitting display apparatuses have a characteristic where luminance is high and an operating voltage is low. Also, since the organic light emitting display apparatuses are self-emitting apparatuses that self-emit light, the organic light emitting display apparatuses are high in contrast ratio, are implemented as ultra-thin display apparatuses, have a response time of several microseconds (p), and are not limited in viewing angle, thereby easily realizing a moving image. Also, the organic light emitting display apparatuses are stably driven even at a low temperature and are driven with a low voltage of direct current (DC) 5 V to 15 V, and thus are easily manufactured and designed.

Therefore, an organic light emitting display apparatus having the above-described features is being applied to televisions (TVs), monitors, various information technology (IT) devices such as mobile terminals, etc.

A basic structure of a plurality of pixels which are provided in a panel applied to an organic light emitting display apparatus is as follows.

Each of the pixels provided in the panel is configured with an array element and an organic light emitting diode (OLED).

The array element includes a switching thin film transistor (TFT), which is connected to a gate line and a data line, and at least one driving TFT connected to the OLED.

The OLED includes a first electrode connected to the driving TFT, an organic emission layer, and a second electrode.

In the pixels having such a configuration, the organic emission layer itself is formed of a plurality of emitting materials that respectively emit red, green, and blue, and thus, a full color is displayed. Also, the whole organic emission layer is formed of an organic emitting material that emits white, and thus, in a case where each of the pixels outputs white light, a color filter pattern including red, green, and blue pigments is provided in correspondence with each pixel. Therefore, white light emitted from the organic emission layer emitting the white light passes through red, green, and blue color filter patterns, and thus, a full color is displayed.

However, in a process (for example, a process of manufacturing a line, a switching TFT, and a driving TFT) of manufacturing a panel having the above-described configuration, a characteristic of a TFT is degraded, or internal short circuit occurs. For this reason, some pixels cannot normally be driven.

For example, when a TFT provided in one pixel is not normally driven, a current or a voltage is not applied to the OLED connected to the TFT, and thus, the one pixel is blackened.

Moreover, when a source electrode and a drain electrode of the driving TFT are short-circuited, the driving TFT is not normally driven, and a voltage applied to the source electrode is directly applied to the drain electrode, whereby a pixel is driven. In this case, the pixel is always turned on and thus is whitened.

When one pixel is blackened or whitened, a blackened area cannot be repaired due to a structural characteristic, and thus, a blackened state is maintained as-is.

Moreover, in a whitened area, an electrical connection between the driving TFT and the first electrode and an electrical connection between the driving TFT and the switching TFT are disconnected through laser cutting. Furthermore, the OLED of a pixel which is whitened is welded, and thus, the first electrode is electrically connected to the second electrode, whereby the pixel is blackened.

Since a whitening defect is seen with a user's eyes due to good visibility, the whitening defect becomes a cause of degrading display quality. For this reason, even when the whitening defect occurs in only a portion of a whole display area, a display apparatus is defective and thus cannot be determined as a finally finished product.

However, a user can hardly recognize a darkened pixel, and thus, even when about 10 to 20 pixels are darkened in the whole display area, a display apparatus is determined as a finally finished product.

Recently, products having a high resolution of full-high definition (FHD) or ultra-high definition (UHD) and high display quality are released, and the demands of consumers for display apparatuses are enhanced. Therefore, zero-defect products which do not include an abnormally driven pixel at all are being required, or products where the number of darkened pixels is five or less are being required.

Therefore, manufacturers of organic light emitting display apparatuses desire to satisfy the demands of consumers, but due to a structural characteristic of the organic light emitting display apparatuses, there is no method of repairing a darkened pixel to a normal pixel. Also, a display area of an organic light emitting display apparatus includes tens to tens of millions of pixels, the manufacturing cost highly increases for manufacturing an organic light emitting display apparatus in order for a defect not to occur in all pixels.

SUMMARY OF THE INVENTION

Accordingly, the present invention is directed to a method of driving an organic light emitting display apparatus that substantially obviates one or more problems due to limitations and disadvantages of the related art.

An aspect of the present invention is directed to a method of driving an organic light emitting display apparatus which, when a defective pixel where at least one organic light emitting diode (OLED) is not normally driven occurs in a plurality of pixels each including two OLEDs, changes input image data corresponding to a data voltage to be supplied to the at least one OLED by using a compensation value.

Another aspect of the present invention is directed to a method of driving an organic light emitting display apparatus which, when a defective pixel where an OLED is not normally driven occurs, changes input image data corresponding to a data voltage to be supplied to the OLED by using a compensation value.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a method of driving an organic light emitting display apparatus including: determining whether input image data, corresponding to a defective pixel which includes two organic light emitting diodes (OLEDs) and has been repaired because at least one of the two OLEDs cannot normally emit light or a normal pixel which is adjacent to the defective pixel and includes two OLEDs normally emitting light, is received; when the received input image data is not the input image data corresponding to the defective pixel or the normal pixel, realigning the input image data to generate normal image data; when the received input image data is the input image data corresponding to the defective pixel or the normal pixel, changing a gray scale of the input image data by using a compensation value to generate compensation image data; and generating a normal data voltage corresponding to the normal image data or a compensation data voltage corresponding to the compensation image data to supply the normal data voltage or the compensation data voltage to a panel where the pixels are provided.

In another aspect of the present invention, there is provided a method of driving an organic light emitting display apparatus including: determining whether input image data, corresponding to a defective pixel which has been repaired because an organic light emitting diode (OLED) cannot normally emit light or a normal pixel which is adjacent to the defective pixel and includes an OLED normally emitting light, is received; when the received input image data is not the input image data corresponding to the defective pixel or the normal pixel, realigning the input image data to generate normal image data; when the received input image data is the input image data corresponding to the defective pixel or the normal pixel, changing a gray scale of the input image data by using a compensation value to generate compensation image data; and generating a normal data voltage corresponding to the normal image data or a compensation data voltage corresponding to the compensation image data to supply the normal data voltage or the compensation data voltage to a panel where the pixels are provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, exemplary embodiments of the present invention will be described in detail with reference to the accompanying drawings.

Details, disclosed in Korean Patent Application No. 10-2013-0143732 filed by the applicant on Nov. 25, 2013, may be applied to the present invention. That is, the present invention relates to a method of driving an organic light emitting display apparatus which is repaired by using repair technology disclosed in Korean Patent Application No. 10-2013-0143732. However, the present invention is not merely applied to organic light emitting display apparatuses which are repaired by using the repair technology disclosed in Korean Patent Application No. 10-2013-0143732. That is, the present invention relates to a method of driving an organic light emitting display apparatus which is repaired by various methods.

Figure 1:
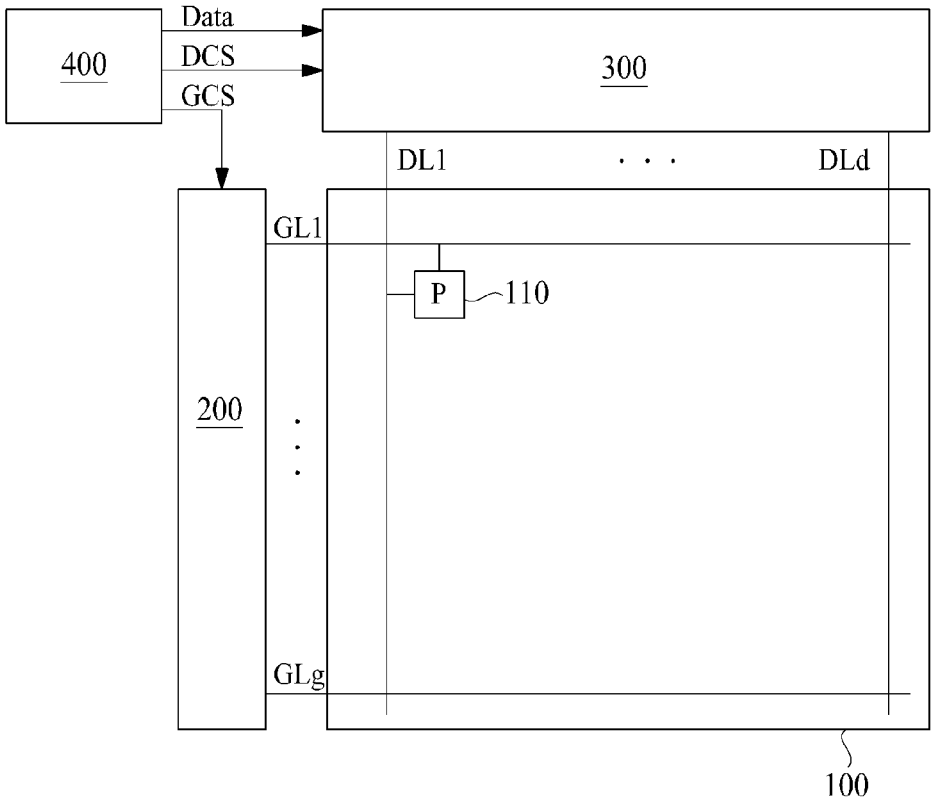
FIG. 1 is an exemplary diagram illustrating a configuration of an organic light emitting display apparatus to which a method of driving an organic light emitting display apparatus according to an embodiment of the present invention is applied.
Figure 2:
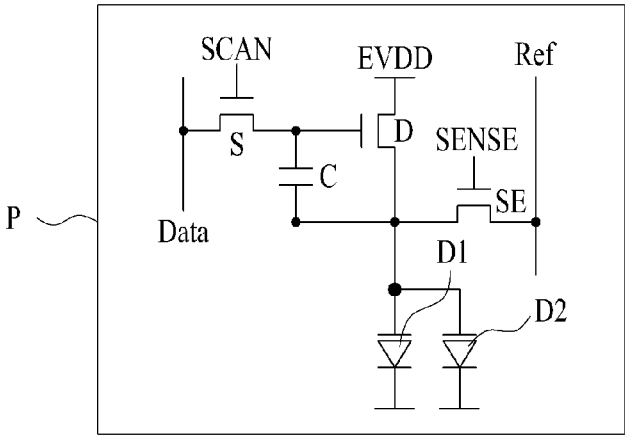
FIG. 2 is a diagram illustrating a configuration of a pixel to which a method of driving an organic light emitting display apparatus according to an embodiment of the present invention is applied.
Figure 3:
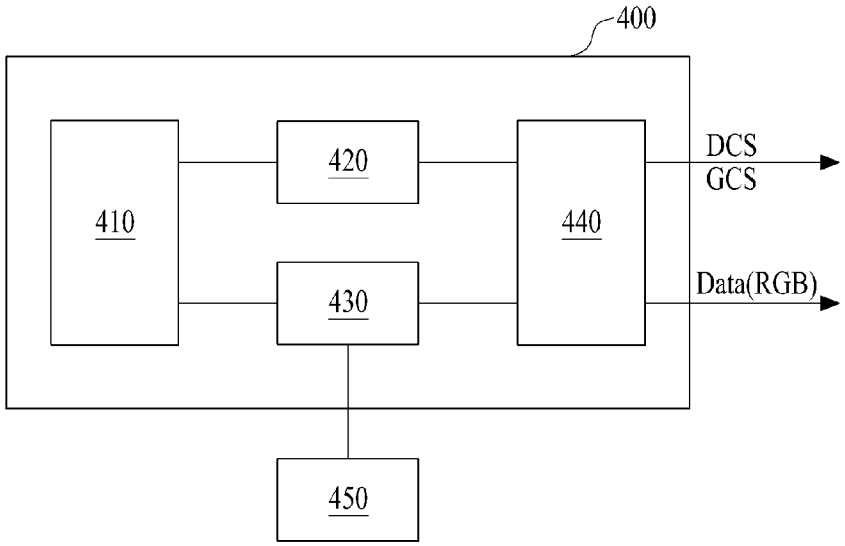
FIG. 3 is a diagram illustrating a configuration of a timing controller to which a method of driving an organic light emitting display apparatus according to an embodiment of the present invention is applied.

FIG. 1 is an exemplary diagram illustrating a configuration of an organic light emitting display apparatus to which a method of driving an organic light emitting display apparatus according to an embodiment of the present invention is applied. FIG. 2 is a diagram illustrating a configuration of a pixel to which a method of driving an organic light emitting display apparatus according to an embodiment of the present invention is applied. FIG. 3 is a diagram illustrating a configuration of a timing controller to which a method of driving an organic light emitting display apparatus according to an embodiment of the present invention is applied.

As illustrated in FIG. 1, the organic light emitting display apparatus according to an embodiment of the present invention may include: a panel 100 where a plurality of pixels (P) 110 are respectively provided in a plurality of intersection areas of a plurality of gate lines GL1 to GLg and a plurality of data lines DL1 to DLd; a gate driver 200 that sequentially supplies a scan pulse to the plurality of gate lines GL1 to GLg provided in the panel 100; a data driver 300 that respectively supplies data voltages to the plurality of data lines DL1 to DLd provided in the panel 100; and a timing controller 400 that controls functions of the gate driver 200 and the data driver 300.

The plurality of pixels (P) 110 may be respectively provided in a plurality of areas defined by intersections of the plurality of gate lines GL and the plurality of data lines DL. The panel 100 may be implemented as a top emission type where lights emitted from a plurality of organic light emitting diodes (OLEDs) are transferred to the outside through an upper substrate, or may be implemented as a bottom emission type where the lights emitted from the OLEDs are transferred to a lower substrate.

Each of the plurality of pixels 100 may include two OLEDs emitting lights and a driver that drives the two OLEDs. For example, as illustrated in FIG. 2, each of the pixels 110 provided in the panel 100 may include a driver, which includes a switching thin film transistor (TFT) S, a driving TFT D, and a storage capacitor C, and two OLEDs D1 and D2.

First, when the scan pulse is supplied to a gate line GL, the driver may control an amount of current supplied to the two OLEDs D1 and D2 according to a data voltage supplied to a data line DL.

To this end, the driving TFT D may be connected between a source voltage EVDD terminal and the two OLEDs D1 and D2, and the switching TFT S may be connected to the driving TFT D, the data line DL, and the gate line GL.

To provide an additional description, the gate line GL may be disposed in a first direction (for example, a horizontal direction) of the pixel P, and the data line DL which defines the pixel P along with the gate line GL may be disposed in a second direction (for example, a vertical direction) intersecting the first direction. A power line for applying the source voltage EVDD may be disposed in parallel with the data line DL.

Moreover, the switching TFT S may be provided in an area defined by intersection of the data line DL and the gate line GL, and the driving TFT D electrically connected to the switching TFT S may be provided in the area.

The driver may include a sensing TFT SE for calculating a threshold voltage or a mobility of the driving TFT D. For example, during a sensing period, a sensing voltage SENSE may be supplied to a gate of the sensing TFT SE to turn on the sensing TFT SE, and a reference voltage Ref may be supplied to the sensing TFT SE through a sensing line.

During the sensing period, a voltage or a current sensed from the sensing TFT SE may be transferred to a sensing unit connected to the sensing line, and the sensing unit may calculate a change amount of the threshold voltage or mobility of the driving TFT D included in the pixel P, based on the voltage or the current. The timing controller may change image data which is to be supplied to the pixel P, based on the calculated change amount.

However, the driver of the pixel P according to an embodiment of the present invention may not include the sensing TFT SE. Hereinafter, thus, a driving method associated with the sensing TFT SE is not described for convenience of a description.

To provide an additional description, the driver may include the driving TFT D, the switching TFT S, and the storage capacitor C, for controlling driving of the two OLEDs D1 and D2 in connection with the data line DL and the gate line GL. In addition, the driver may further include a plurality of transistors for sensing or compensating for characteristics of the OLEDs D1 and D2 and a plurality of elements connected to the plurality of transistors.

Second, a first electrode that is one terminal of each of the OLEDs D1 and D2 may be connected to a first electrode of the driving TFT D, and a second electrode that is the other terminal may be grounded.

A second electrode of the driving TFT D may be connected to a power supply, which supplies the source voltage EVDD, through the power line. Therefore, the source voltage EVDD may be transferred to the OLEDs D1 and D2 through the power line.

The storage capacitor C may be provided between the gate electrode and the first electrode of the driving TFT D.

Therefore, when a signal is applied through the gate line GL, the switching TFT S may be turned on, and a signal applied through the data line DL may be transferred to the gate electrode of the driving TFT D. Therefore, the driving TFT D may be turned on, and thus, the two OLEDs D1 and D2 may emit lights.

When the driving TFT D is turned on, a level of a current flowing from the power line to the OLEDs D1 and D2 may be adjusted, and thus, the OLEDs D1 and D2 may realize gray scales.

When the switching TFT S is turned off, the storage capacitor C may hold a constant gate voltage of the driving TFT D. Even when the switching TFT S is turned off, a constant level of the current flowing in the OLEDs D1 and D2 may be held by the storage capacitor C until a next frame.

Each of the OLEDs D1 and D2 may emit light having luminance corresponding to a data current according to a data current supplied from the driving TFT T. To this end, each of the OLEDs D1 and D2 may include a first electrode (for example, an anode electrode) connected to the driving TFT T, an organic emission layer (not shown) disposed on the first electrode, and a second electrode (for example a cathode electrode) connected to the organic emission layer.

The first electrodes of the two OLEDs D1 and D2 may be connected to the first electrode of the driving TFT T in common.

The timing controller 400 outputs a gate control signal GCS for controlling the gate driver 200 and a data control signal DCS for controlling the data driver 300 by using a vertical sync signal, a horizontal sync signal, a clock, and/or the like which are supplied from an external system (not shown).

The timing controller 400 samples input image data received from the external system, realigns the sampled image data, and supplies realigned digital image data to the data driver 300.

In detail, the timing controller 400 realigns the input image data supplied from the external system, and supplies the realigned digital image data to the data driver 300. Also, the timing controller 400 generates the gate control signal GCS for controlling the gate driver 200 and the data control signal DCS for controlling the data driver 300 by using a plurality of timing signals such as the vertical sync signal, the horizontal sync signal, the clock, and/or the like which are supplied from the external system, and respectively transfers the gate control signal GCS and the data control signal DCS to the gate driver 200 and the data driver 300.

Particularly, the timing controller 400 includes: a receiver 410 that receives the input image data and the timing signals from the external system; an image data processor 430 that realigns the input image data received from the receiver 410 so as to match the panel 100, and generates the realigned digital image data; a control signal generator 420 that generates the gate control signal GCS for controlling the gate driver 200 and the data control signal DCS for controlling the data driver 300 by using the timing signals received from the receiver 410; and a transferor 440 that respectively outputs the control signals, generated by the control signal generator 420, to the gate driver 200 and the data driver 300, and outputs the image data, generated by the image data processor 430, to the data driver 300. Also, the organic light emitting display apparatus according to an embodiment of the present invention may further include a storage unit 450 that stores a compensation value for changing image data supplied to a defective pixel including a whitened OLED. The storage unit 450, as illustrated in FIG. 3, may be implemented independently from the timing controller 400 or may be included in the timing controller 400.

In the following description, among the two OLEDs D1 and D2 configuring the pixel P, an OLED which is disconnected from the driver in a repair process because the OLED is not normally driven may be referred to as a blackened OLED.

Moreover, an OLED which is included in one pixel along with the blackened OLED and is normally driven even after the repair process may be referred to as a whitened OLED.

Moreover, a pixel which includes one or two OLEDs which are not normally driven may be referred to as a defective pixel.

A below-described defective pixel applied to a first embodiment of the present invention may include two whitened OLEDs. In this case, in the defective pixel, the driver may not normally operate, and the two OLEDs D1 and D2 may be normal.

A defective pixel applied to a second embodiment of the present invention may include one blackened OLED and one whitened OLED. In this case, the driver included in the defective pixel may normally operate.

A defective pixel applied to a third embodiment of the present invention may include one blackened OLED and one whitened OLED. In this case, the driver included in the defective pixel may be normally driven or may not normally be driven.

A pixel, which is adjacent to the defective pixel along the data line DL and includes two OLEDs which are normally driven, may be referred to as a normal pixel. The normal pixel may be disposed on or under the defective pixel along the data line DL. Hereinafter, however, for convenience of a description, the panel 100 where the normal pixel is disposed on the defective pixel along the data line DL will be described an example of the present invention.

First, the receiver 410 may receive input image data and various signals from the external system (not shown). Here, the various signals may include the timing signals (for example, the vertical sync signal, the horizontal sync signal, the clock, and/or the like) which are used to generate various control signals to be described below.

The receiver 410 may determine whether input image data, corresponding to a defective pixel which includes two OLEDs and has been repaired because at least one of the two OLEDs cannot normally emit light or a normal pixel which is adjacent to the defective pixel and includes two OLEDs which normally emit lights, is received.

To this end, the receiver 410 or the storage unit 450 may store information about the defective pixel or the normal pixel. For example, when the input image data is received, the receiver 410 may determine whether the input image data is input image data corresponding to the defective pixel or the normal pixel, based on the information about the defective pixel or the normal pixel stored in the receiver 410 or the storage unit 450.

Second, the image data processor 430 may realign the input image data received from the receiver 410 so as to match a pixel structure of the panel 100, thereby generating image data.

Particularly, when input image data corresponding to a defective pixel repaired by the repair process or a normal pixel adjacent to the defective pixel is received, the image data processor 430 may change the input image data to generate compensation image data, based on the compensation value stored in the storage unit 450.

Moreover, when input image data corresponding to a pixel other than the normal pixel or the defective pixel is received, the image data processor 430 may realign the input image data to generate normal image data.

A generic name for the compensation image data and the normal image data may be image data.

Third, the control signal generator 420 may generate the gate control signal GCS which is to be transferred to the gate driver 200 and a data control signal which is to be transferred to the data driver 300.

Fourth, the transferor 440 may transfer the image data and the data control signal to the data driver 300 and transfer the gate control signal to the gate driver 200.

Fifth, the storage unit 450 may store the compensation value or various pieces of information which are used to calculate the compensation value. When the image data processor 430 or the receiver 410 requests the compensation value, the storage 450 may transfer the compensation value to the image data processor 430. The image data processor 430 may generate the compensation image data by using the compensation value.

The data driver 300 converts the image data, input from the timing controller 400, into analog data voltages, and respectively supplies data voltages for one horizontal line to the data lines at every one horizontal period where the scan pulse is supplied to a corresponding gate line. That is, the data driver 300 converts the image data into the data voltages by using gamma voltages supplied from a gamma voltage generator (not shown), and respectively outputs the data voltages to the data lines.

For example, the data driver 300 shifts a source start pulse SSP from the timing controller 400 according to a source shift clock SSC to generate a sampling signal. The data driver 300 latches the image data, input according to the source shift clock SSC, according to the sampling signal, and converts the image data into the data voltages. Then, the data driver 300 respectively supplies the data voltages to the data lines in units of a horizontal line in response to a source output enable signal SOE. Here, the normal image data may be converted into a normal data voltage, and the compensation image data may be converted into a compensation data voltage. A generic name for the normal data voltage and the compensation image data may be a data voltage.

To perform the above-described functions, the data driver 300 may include a shift register, a latch, a digital-to-analog converter (DAC), and an output buffer.

The shift register outputs the sampling signal by using data control signals received from the timing controller 400.

The latch latches the digital image data which are sequentially received from the timing controller 400, and then simultaneously outputs the latched image data to the DAC.

The DAC converts the image data, transferred from the latch, into the data voltages, and outputs the data voltages. That is, the DAC converts the image data into the data voltages by using the gamma voltages supplied from the gamma voltage generator (not shown), and respectively outputs the data voltages to the data lines.

The output buffer respectively outputs the data voltages, transferred from the DAC, to the data lines DL of the panel 100 according to the source output enable signal SOE transferred from the timing controller 400.

The gate driver 200 sequentially supplies the scan pulse to the gate lines GL1 to GLg of the panel 100 in response to the gate control signal input from the timing controller 400. Therefore, a plurality of switching transistors which are respectively formed in a plurality of sub-pixels 110 on a corresponding horizontal line to which the scan pulse is applied are turned on, and an image may be output to each of the pixels 110.

That is, the gate driver 200 shifts a gate start pulse GSP transferred from the timing controller 400 according to a gate shift clock GSC to sequentially supply the scan pulse having a gate-on voltage to the gate lines GL1 to GLg. Also, during the other period where the scan pulse is not supplied, the gate driver 200 supplies a gate-off voltage to the gate lines GL1 to GLg.

The gate driver 200 may be provided independently from the panel 100, and may be configured in a type which is electrically connected to the panel 100 by various manners. However, the gate driver 200 may be configured in a gate-in panel (GIP) type which is equipped in the panel 100. In this case, a gate control signal for controlling the gate driver 200 may include a start signal VST and a gate clock GCLK.

Moreover, hereinabove, it has been described that the data driver 300, the gate driver 200, and the timing controller 400 are separately provided, but at least one selected from the data driver 300 and the gate driver 200 may be provided as one body with the timing controller 400. Hereinafter, also, a generic name for the gate driver 200, the data driver 300, and the timing controller 400 is a panel driver.

Figure 4:
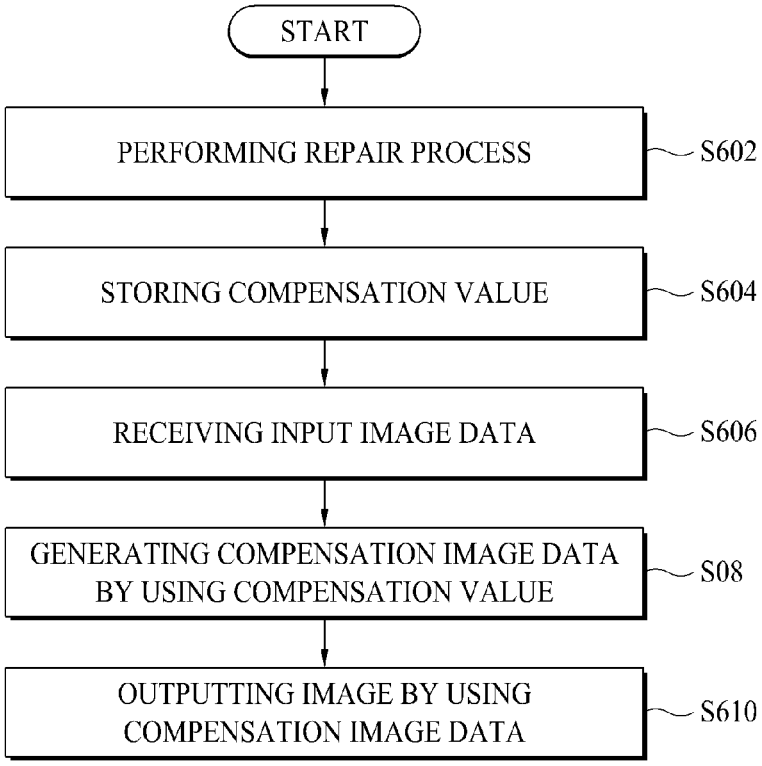
FIG. 4 is a flowchart illustrating a method of driving an organic light emitting display apparatus according to an embodiment of the present invention.
Figure 5:
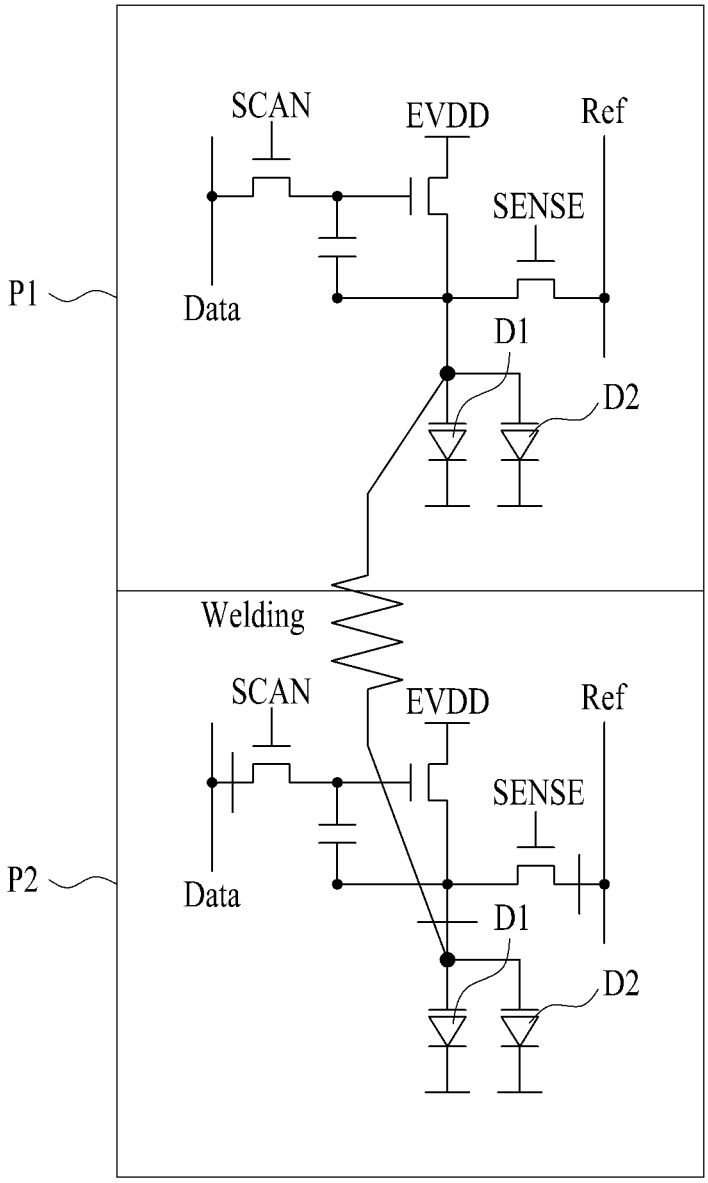
FIG. 5 is an exemplary diagram illustrating two pixels to which a method of driving an organic light emitting display apparatus according to a first embodiment of the present invention is applied.
Figure 6:
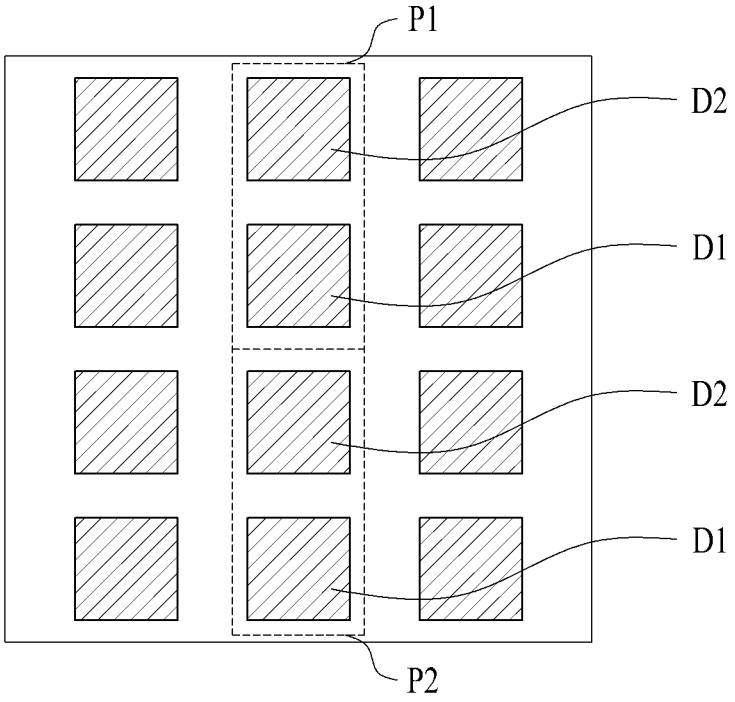
FIG. 6 is an exemplary diagram illustrating a state where light is emitted based on the method of driving the organic light emitting display apparatus according to the first embodiment of the present invention.
Figure 7:
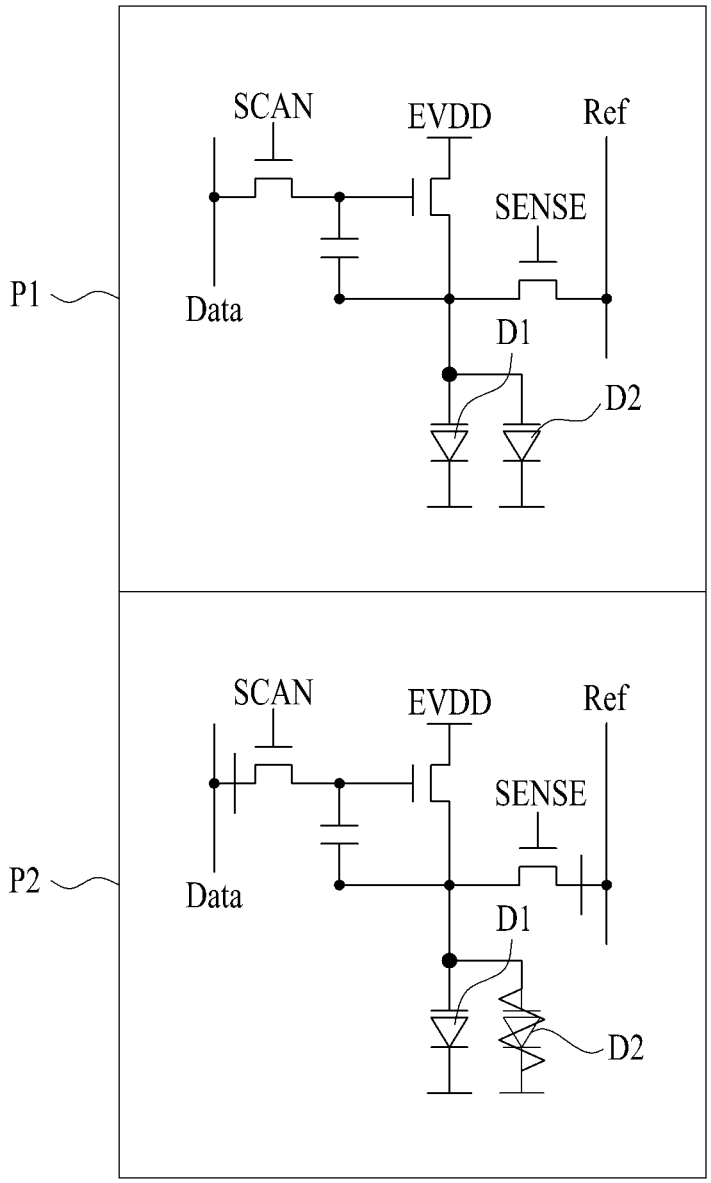
FIG. 7 is an exemplary diagram illustrating two pixels to which a method of driving an organic light emitting display apparatus according to a second embodiment of the present invention is applied.
Figure 8:
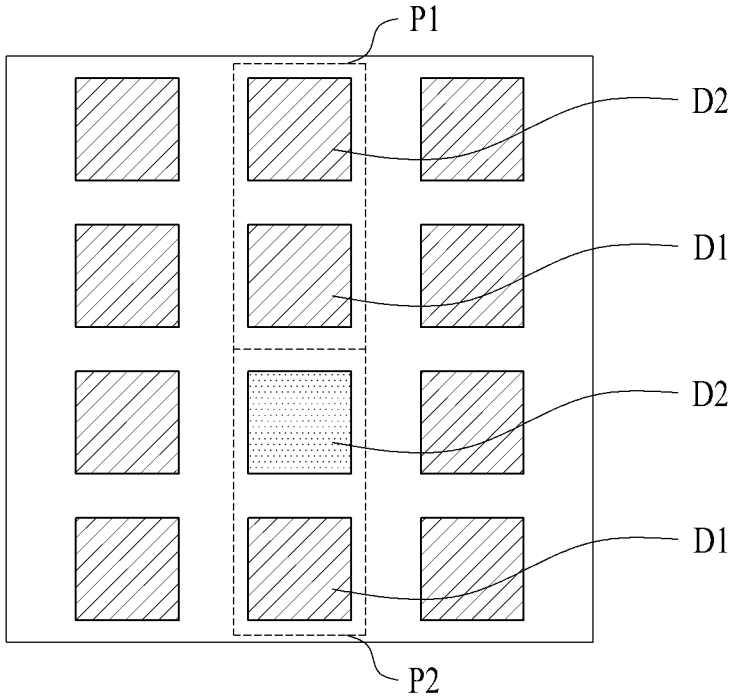
FIG. 8 is an exemplary diagram illustrating a state where light is emitted based on the method of driving the organic light emitting display apparatus according to the second embodiment of the present invention.
Figure 9:
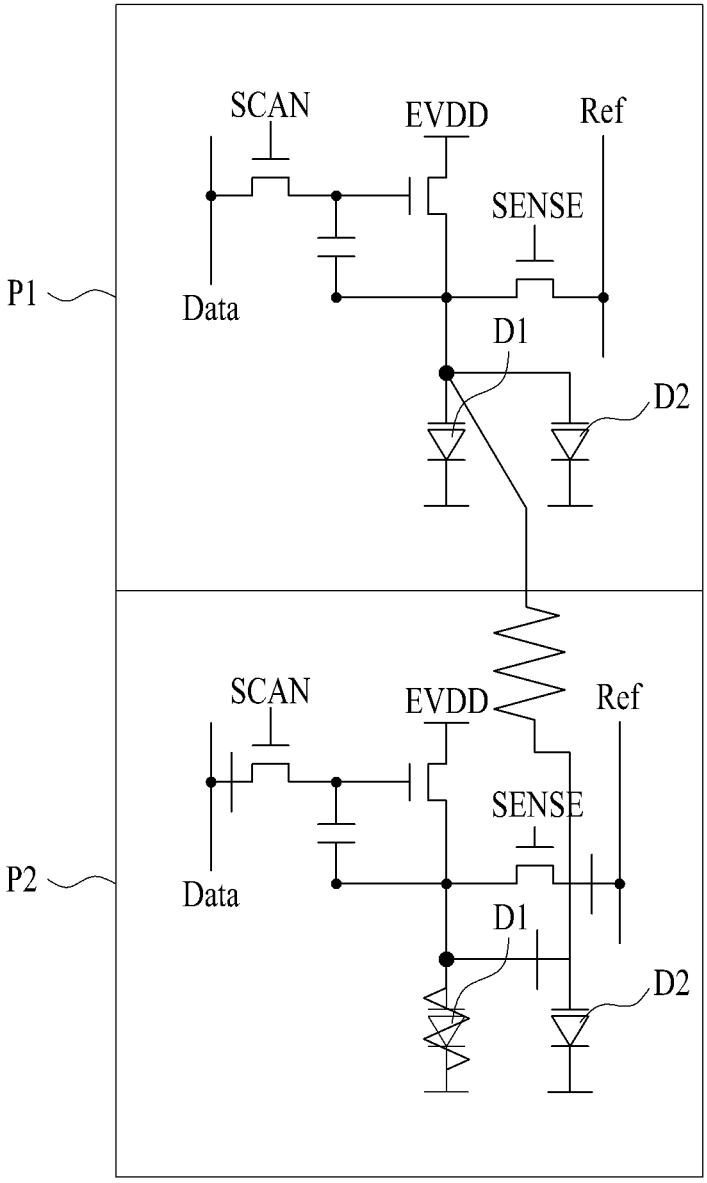
FIG. 9 is an exemplary diagram illustrating two pixels to which a method of driving an organic light emitting display apparatus according to a third embodiment of the present invention is applied.
Figure 10:
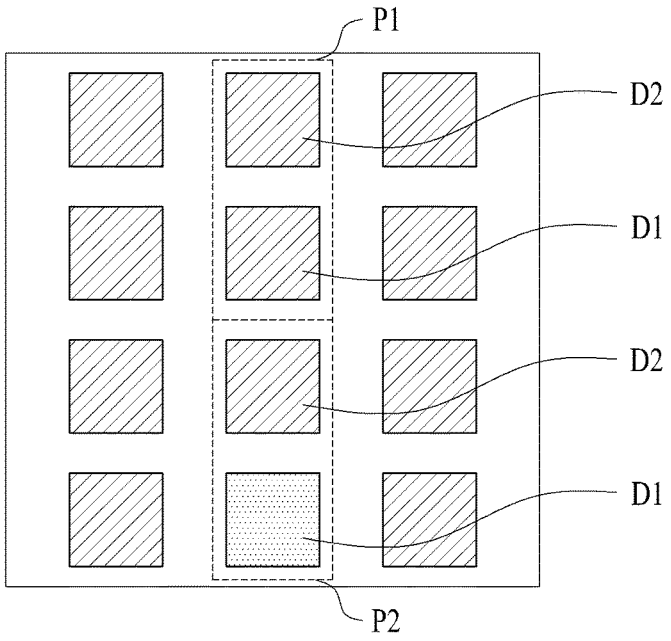
FIG. 10 is an exemplary diagram illustrating a state where light is emitted based on the method of driving the organic light emitting display apparatus according to the third embodiment of the present invention.
Figure 11:
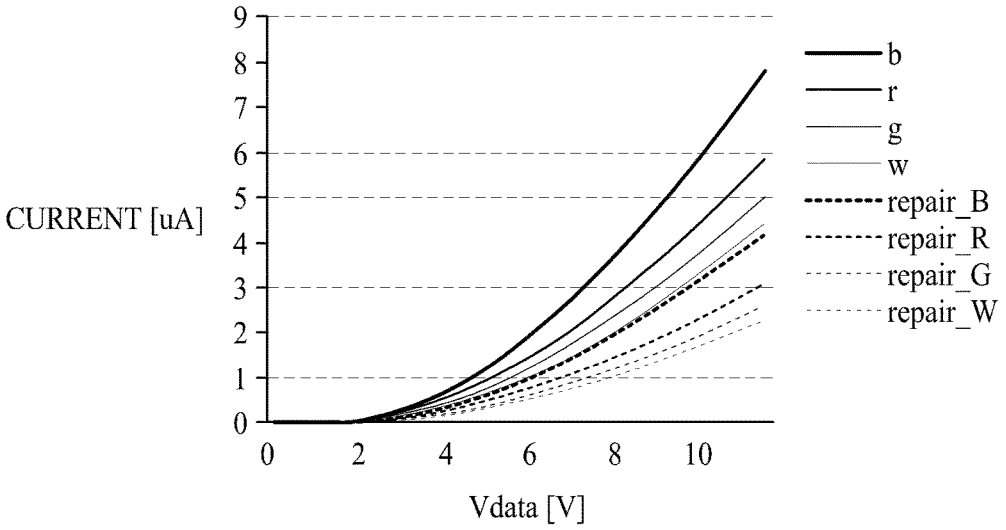
FIG. 11 is an exemplary diagram for describing a cause by which a compensation value applied to a method of driving an organic light emitting display apparatus according to an embodiment of the present invention is changed based on colors.
Figure 12:
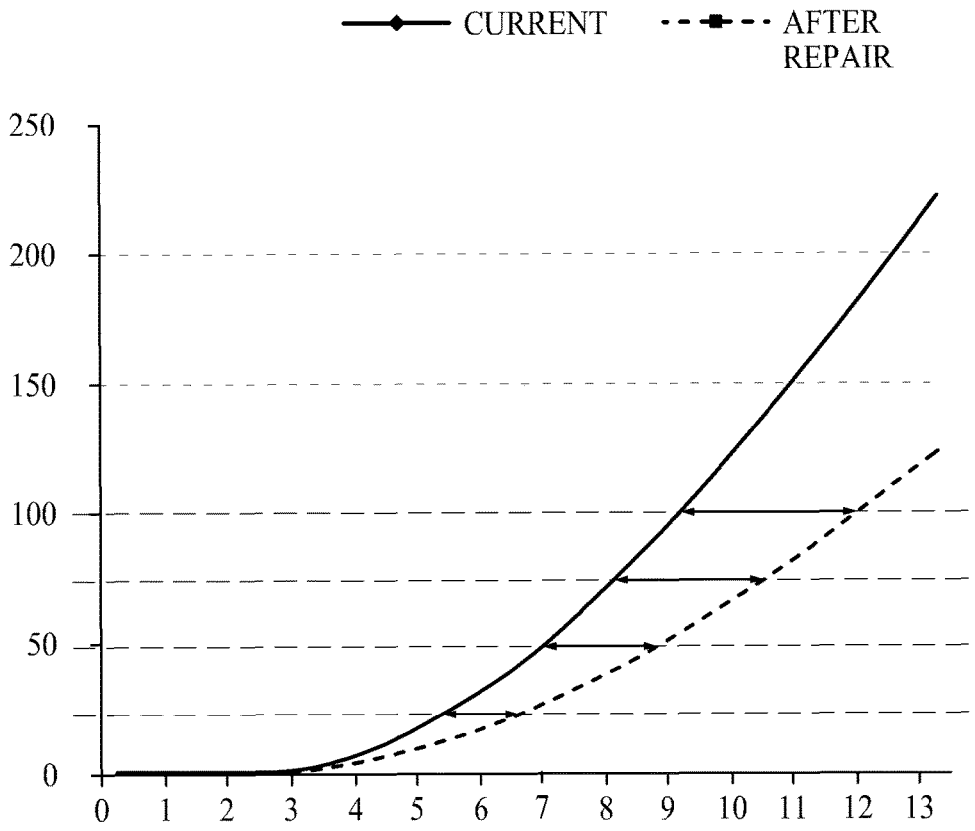
FIG. 12 is an exemplary diagram for describing a cause by which a compensation value applied to a method of driving an organic light emitting display apparatus according to an embodiment of the present invention is changed based on gray scales.

FIG. 4 is a flowchart illustrating a method of driving an organic light emitting display apparatus according to an embodiment of the present invention. FIG. 5 is an exemplary diagram illustrating two pixels to which a method of driving an organic light emitting display apparatus according to a first embodiment of the present invention is applied. FIG. 6 is an exemplary diagram illustrating a state where light is emitted based on the method of driving the organic light emitting display apparatus according to the first embodiment of the present invention. FIG. 7 is an exemplary diagram illustrating two pixels to which a method of driving an organic light emitting display apparatus according to a second embodiment of the present invention is applied. FIG. 8 is an exemplary diagram illustrating a state where light is emitted based on the method of driving the organic light emitting display apparatus according to the second embodiment of the present invention. FIG. 9 is an exemplary diagram illustrating two pixels to which a method of driving an organic light emitting display apparatus according to a third embodiment of the present invention is applied. FIG. 10 is an exemplary diagram illustrating a state where light is emitted based on the method of driving the organic light emitting display apparatus according to the third embodiment of the present invention. FIG. 11 is an exemplary diagram for describing a cause by which a compensation value applied to a method of driving an organic light emitting display apparatus according to an embodiment of the present invention is changed based on colors. FIG. 12 is an exemplary diagram for describing a cause by which a compensation value applied to a method of driving an organic light emitting display apparatus according to an embodiment of the present invention is changed based on gray scales.

In operation S602, a repair process may be performed for the panel 100 where a defective pixel occurs.

First, as illustrated in FIG. 5, the panel 100 applied to the first embodiment of the present invention may include a defective pixel P2 and a normal pixel P1 adjacent to the defective pixel P2.

The defective pixel P2 may include two whitened OLEDs D1 and D2. The two whitened OLEDs D1 and D2 may be normally driven even after the repair process.

To provide an additional description, in the defective pixel P2 which occurs in the pixel 100 applied to the first embodiment of the present invention, the driver may not normally operate, and the two whitened OLEDs D1 and D2 may be normal.

In this case, as illustrated in FIG. 5, the two whitened OLEDs D1 and D2 included in the defective pixel P2 may be connected to OLEDs included in the normal pixel P1 in parallel and may be connected to a first electrode of a driving TFT D included in the normal pixel P1, through the repair process.

To this end, the first electrode of the driving TFT D included in the normal pixel P1 may be electrically connected to first electrodes of the two whitened OLEDs D1 and D2 included in the defective pixel P2 through a welding process.

In this case, a switching TFT included in the defective pixel P2 may be isolated from a data line, the two whitened OLEDs D1 and D2 may be isolated from the driving TFT D included in the defective pixel P2, and a sensing TFT may be provided. The sensing TFT may be isolated from a sensing line through which a reference voltage is supplied.

Second, as illustrated in FIG. 7, the panel 100 applied to the second embodiment of the present invention may include a defective pixel P2 and a normal pixel P1 adjacent to the defective pixel P2.

The defective pixel P2 may include one blackened OLED D2 and one whitened OLED D1. The driver included in the defective pixel P2 may normally operate. That is, only one (for example, the blackened OLED D2) of two the OLEDs included in the defective pixel P2 may not normally be driven due to a defect.

In this case, the blackened OLED D2 included in the defective pixel P2 may be isolated from the first electrode of the driving TFT D through the repair process. Therefore, the blackened OLED D2 may not electrically be connected to the whitened OLED D1.

Third, as illustrated in FIG. 9, the panel 100 applied to the third embodiment of the present invention may include a defective pixel P2 and a normal pixel P1 adjacent to the defective pixel P2.

The defective pixel P2 may include one whitened OLED D2 and one blackened OLED D1. The whitened OLED D2 may be normally driven even after the repair process. The driver included in the defective pixel P2 may normally operate or may not normally operate.

In this case, as illustrated in FIG. 9, the whitened OLED D2 included in the defective pixel P2 may be connected to OLEDs included in the normal pixel P1 in parallel and may be connected to a first electrode of a driving TFT D included in the normal pixel P1, through the repair process.

To this end, the first electrode of the driving TFT D included in the normal pixel P1 may be electrically connected to a first electrode of the whitened OLED D2 included in the defective pixel P2 through a welding process.

In this case, a switching TFT included in the defective pixel P2 may be isolated from a data line, and the whitened OLED D2 may be isolated from the driving TFT D included in the defective pixel P2. When a sensing TFT is provided, the sensing TFT may be isolated from a sensing line through which the reference voltage is supplied. Also, the blackened OLED D1 may be isolated from the whitened OLED D2.

In operation S604, a compensation value or various pieces of compensation information used to calculate the compensation value may be stored in the storage unit 450. The compensation value or the compensation information may be calculated through various simulations in a process of manufacturing the panel 100 and may be stored in the storage unit 450.

First, the compensation value may be set as a certain value for the defective pixel P2 or the normal pixel P1 and then may be stored in the storage unit 450.

In this case, the compensation value may be constant for all colors, all defective pixels P2, and all normal pixels P1.

To provide an additional description, gray scales of pieces of input image data respectively corresponding to all the defective pixels P2 or all the normal pixels P1 may increase or decrease according to the same compensation value. Therefore, in comparison with a before-compensation data voltage, compensation data voltages respectively supplied to all the defective pixels P2 or all the normal pixels P1 may increase or decrease at the same level.

Second, the compensation value may be calculated based on a gray scale of the input image data, a position of a horizontal line where a defective pixel occurs in the panel 100, or a color corresponding to the input image data, and pieces of compensation information for calculating the compensation value may be stored in the storage unit 450.

For example, a compensation value for R input image data corresponding to an R normal pixel or an R defective pixel may be rV, a compensation value for W input image data corresponding to a W normal pixel or a W defective pixel may be wV, a compensation value for G input image data corresponding to a G normal pixel or a G defective pixel may be gV, and a compensation value for B input image data corresponding to a B normal pixel or a B defective pixel may be bV.

To provide an additional description, as shown in FIG. 11, characteristics of gamma curves may differ by colors, and thus, the compensation value may be changed based on colors.

The compensation value may be changed based on a gray scale of the input image data.

To provide an additional description, as shown in FIG. 12, data voltages to be compensated for may differ by gray scales, and thus, the compensation value may be changed based on a gray scale of the input image data.

Moreover, the compensation value may be changed based on a position of a horizontal line where a normal pixel or a defective pixel, to which a compensation data voltage corresponding to the input image data is to be output, is provided. For example, a compensation value of input image data which is to be output to a defective pixel or a normal pixel provided on a horizontal line disposed at an upper portion of the panel 100, a compensation value of input image data which is to be output to a defective pixel or a normal pixel provided on a horizontal line disposed at a middle portion of the panel 100, and a compensation value of input image data which is to be output to a defective pixel or a normal pixel provided on a horizontal line disposed at a lower portion of the panel 100 may differ.

Third, the compensation value may be calculated based on at least two of a gray scale of input image data, a position of a horizontal line where a defective pixel occurs in the panel 100, and a color corresponding to the input image data, and various pieces of compensation information for calculating the compensation value may be stored in the storage unit 450.

For example, the compensation value may be calculated based on at least two of the gray scale of the input image data, the position of the horizontal line, and the color. That is, as described above, the compensation value may be variously changed depending on the gray scale of the input image data, the position of the horizontal line, and the color and thus may be calculated based on at least two of the above-described pieces of information.

In the present embodiment, as described above, by complementing a current which flows to OLEDs included in a normal pixel or a defective pixel, the compensation value may be added to input image data so as to increase or lower luminance of the OLEDs. The compensation value added to the input image data may be a value associated with a gray scale. However, a compensation data voltage may substantially increase or be lowered according to the compensation value. Therefore, the compensation value may be a value associated with a voltage among various pieces of information included in the input image data.

To provide an additional description, the compensation value may be generated based on various variables.

Subsequently, in operation S606, the receiver 410 may determine whether input image data, corresponding to a defective pixel which includes two OLEDs and has been repaired because at least one of the two OLEDs cannot normally emit light or a normal pixel which is adjacent to the defective pixel and includes two OLEDs which normally emit lights, is received.

In this case, the receiver 410 may use information about the defective pixel or the normal pixel stored in the receiver 410 or the storage unit 450.

For example, in the first embodiment, when the two OLEDs D1 and D2 included in the defective pixel P2 are repaired to be connected to a driver included in the normal pixel P1 because a driver which is provided in the defective pixel P2 to drive the two OLEDs D1 and D2 is not normally driven, the receiver 410 may determine whether the input image data is input image data corresponding to the normal pixel P1.

In the second embodiment, when the OLED D2 which is not normally driven among the two OLEDs D1 and D2 included in the defective pixel P2 is repaired to be isolated from a driver included in the defective pixel so as to drive the two OLEDs D1 and D2, the receiver 410 may determine whether the input image data is input image data corresponding to the defective pixel P2.

In the third embodiment, when the OLED D2 which is normally be driven among the two OLEDs D1 and D2 included in the defective pixel P2 is repaired to be connected to a driver for driving two OLEDs included in the normal pixel P1, the receiver 410 may determine whether the input image data is input image data corresponding to the normal pixel P1.

Subsequently, when the received input image data is not the input image data corresponding to the defective pixel P2 or the normal pixel P1 as a result of the determination, the receiver 410 may transfer the input image data to the image data processor 430. The image data processor 430 may realign the input image data to generate normal image data.

That is, pieces of input image data corresponding to pixels other than the defective pixel P2 or the normal pixel P1 may be realigned to normal image data by the image data processor 430.

Subsequently, when the received input image data is the input image data corresponding to the defective pixel P2 or the normal pixel P1 as a result of the determination, the receiver 410 may transfer the input image data and a control signal, which allows the input image data to be changed based on a compensation value, to the image data processor 430. In operation S608, the image data processor 430 may change a gray scale of the input image data by using the compensation value to generate the compensation image data.

In this case, the compensation value may be stored in the storage unit 450, may be a value which is calculated by the receiver 410 by using the input image data and various pieces of compensation information stored in the storage unit 450 or the receiver 410 and is transferred to the image data processor 430, or may be a value which is directly calculated by the image data processor 430 by using the input image data and the various pieces of compensation information stored in the storage unit 450, the receiver 410, or the image data processor 430.

Here, the compensation value may be set as a certain value for the defective pixel P2 or the normal pixel P1.

Moreover, the compensation value may be changed depending on a gray scale of the input image data, a position of a horizontal line where the defective pixel P2 occurs in the panel 100, or a color corresponding to the input image data.

Moreover, the compensation value may be calculated based on at least two of the gray scale of the input image data, the position of the horizontal line where the defective pixel P2 occurs in the panel 100, and the color corresponding to the input image data.

For example, in the first embodiment, the image data processor 430 may increase a gray scale of the input image data corresponding to the normal pixel P1 by using the compensation value to generate the compensation image data.

In the first embodiment, the two OLEDs included in the normal pixel P1 and the two OLEDs included in the defective pixel P2 may be driven with the input image data corresponding to the normal pixel P1 to emit light. Therefore, in the first embodiment, a gray scale of the input image data corresponding to the normal pixel P1 may increase, and thus, the compensation data voltage supplied to the normal pixel P1 may increase. Accordingly, luminance of the OLEDs included in the normal pixel P1 and the defective pixel P2 may have a level similar to that of luminance based on a data voltage corresponding to the input image data.

In the second embodiment, the image data processor 430 may decrease a gray scale of the input image data corresponding to the defective pixel P2 by using the compensation value to generate the compensation image data.

In the second embodiment, only one OLED D1 of the two OLEDs included in the defective pixel P2 may be driven with the compensation data voltage supplied to the defective pixel P2 to emit light. Therefore, in the second embodiment, a gray scale of the input image data corresponding to the defective pixel P2 may decrease, and thus, the compensation data voltage supplied to the defective pixel P2 may decrease. Accordingly, luminance of the OLED D1 included in the defective pixel P2 may have a level similar to that of luminance based on a data voltage corresponding to the input image data.

In the third embodiment, the image data processor 430 may increase a gray scale of the input image data corresponding to the normal pixel P1 by using the compensation value to generate the compensation image data.

In the third embodiment, the two OLEDs included in the normal pixel P1 and one OLED D2 included in the defective pixel P2 may be driven with the input image data corresponding to the normal pixel P1 to emit light. Therefore, in the third embodiment, a gray scale of the input image data corresponding to the normal pixel P1 may increase, and thus, the compensation data voltage supplied to the normal pixel P1 may increase. Accordingly, luminance of the OLEDs included in the normal pixel P1 and the defective pixel P2 may have a level similar to that of luminance based on a data voltage corresponding to the input image data.

In this case, a level of the compensation value applied to the third embodiment may be lower than that of the compensation value applied to the first embodiment. For example, in the first embodiment, four OLEDs may be driven with one data voltage to emit light, and in the second embodiment, three OLEDs may be driven with one data voltage to emit light. Therefore, a level of the compensation value applied to the first embodiment may be higher than that of the compensation value applied to the second embodiment.

However, the present invention is not limited thereto. That is, as described above, the compensation value may be calculated based on various variables, and thus, the compensation value applied to the first embodiment may be or not higher in level than the compensation value applied to the third embodiment.

The normal image data and the compensation image data generated by the image data processor 430 may be transferred to the data driver 300 through the transferor 440.

The data driver 300 may generate a normal data voltage corresponding to the normal image data or a compensation data voltage corresponding to compensation image data and supply the normal data voltage or the compensation data voltage to the panel 100 including the pixels, and the defective pixel P2, the normal pixel P1, and the pixels 110 may emit light with the normal data voltage or the compensation data voltage. Therefore, the panel 100 may display an image.

In this case, according to the first embodiment, as illustrated in FIG. 6, luminance of the two OLEDs included in the normal pixel P1 and luminance of the two OLEDs included in the defective pixel P2 may not be brighter or darker than those of OLEDs included in peripheral pixels.

According to the second embodiment, as illustrated in FIG. 8, one OLED D2 of the two OLEDs included in the defective pixel P2 may be blackened not to emit light, but luminance of the other OLED D1 may not be brighter or darker than those of OLEDs included in peripheral pixels.

According to the third embodiment, as illustrated in FIG. 10, one OLED D1 of the two OLEDs included in the defective pixel P2 may be blackened not to emit light, but luminance of the other OLED D2 and luminance of the two OLEDs included in the normal pixel P1 may not be brighter or darker than those of OLEDs included in peripheral pixels.

Hereinafter, a method of driving an organic light emitting display apparatus according to an embodiment of the present invention will be briefly summarized.

A defective pixel may be repaired, and thus, when two OLEDs included in the defective pixel are driven with a data voltage supplied to a normal pixel, luminance of OLEDs included in the defective pixel and the normal pixel may be lower than those of OLEDs included in peripheral pixels. Also, a defective pixel may be repaired, and thus, when one of two OLEDs included in the defective pixel is driven with a data voltage supplied to the defective pixel, luminance of the one OLED may be lower than those of OLEDs included in peripheral pixels and a normal pixel. Also, a defective pixel may be repaired, and thus, when one of two OLEDs included in the defective pixel is driven with a data voltage supplied to a normal pixel, luminance of the one OLED included in the defective pixel and luminance of two OLEDs included in the normal pixel may be lower than those of OLEDs included in peripheral pixels.

The present invention is for preventing luminance from increasing or decreasing. That is, the present invention is for preventing luminance of two OLEDs, included in a repaired defective pixel, from becoming too higher or lower than those of OLEDs included in pixels near the repaired defective pixel.

To this end, when two OLEDs included in a defective pixel are driven with a data voltage supplied to a normal pixel, the present invention may increase the data voltage by using the compensation value.

Moreover, when only one of two OLEDs included in a defective pixel is normally driven, the present invention may decrease a data voltage supplied to the defective pixel by using the compensation value.

Moreover, when one of two OLEDs included in a defective pixel is driven with a data voltage supplied to a normal pixel, the present invention may increase the data voltage by using the compensation value.

Hereinabove, the reference document and the panel where two OLEDs are provided in one pixel have been described as an example of the present invention.

However, the present invention may be applied to a panel where one OLED is provided in one pixel. That is, when a defective pixel where an OLED is not normally driven occurs, input image data corresponding to a data voltage which is to be supplied to the OLED may be changed based on a compensation value. In the following description, details which are the same as or similar to the above-described details are not described or will be briefly described.

For example, in the first embodiment illustrated in FIG. 5, even when only one OLED is provided in each of the defective pixel P1, the normal pixel P1, and the other pixels included in the panel 100, an OLED included in the defective pixel P2 may be driven with the compensation data voltage supplied to the normal pixel P1.

Moreover, it has been described above that two OLEDs are provided in each pixel of the panel applied to the second embodiment illustrated in FIG. 7, but the two OLEDs may be formed by the repair process. For example, when one OLED is divided by a bank in each pixel, one of two parts divided by the bank may not be driven due to a limitation of an organic emission layer. In this case, as illustrated in FIG. 7, when two OLEDs are provided by the repair process, the above-described second embodiment may be applied as-is.

Moreover, it has been described above that two OLEDs are provided in each pixel of the panel applied to the third embodiment illustrated in FIG. 9, but the two OLEDs may be formed by the repair process. For example, when one OLED is divided by a bank in each pixel, one of two parts divided by the bank may not be driven due to a limitation of an organic emission layer. In this case, as illustrated in FIG. 9, two OLEDs may be provided by the repair process. As illustrated in FIG. 9, when two OLEDs are provided by the repair process, the above-described third embodiment may be applied as-is.

As described above, according to the embodiments of the present invention, at least one OLED included in a defective pixel where a defect occurs may be driven with a compensation data voltage obtained through change based on a compensation value, and thus, a luminance of the OLED included in the defective pixel is prevented from becoming abnormally higher or lower than that of an OLED included in each of pixels near the defective pixel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of driving an organic light emitting display apparatus, the method comprising:

determining whether input image data, corresponding to a defective pixel which includes two organic light emitting diodes (OLEDs) and has been repaired because at least one of the two OLEDs cannot normally emit light or a normal pixel which is adjacent to the defective pixel and includes two OLEDs normally emitting light, is received;

when the received input image data is not the input image data corresponding to the defective pixel or the normal pixel, realigning the input image data to generate normal image data;

when the received input image data is the input image data corresponding to the defective pixel or the normal pixel, changing a gray scale of the input image data by using a compensation value to generate compensation image data; and generating a normal data voltage corresponding to the normal image data or a compensation data voltage corresponding to the compensation image data to supply the normal data voltage or the compensation data voltage to a panel where the pixels are provided, wherein the determining comprises, when the two OLEDs included in the defective pixel are repaired to be connected to a driver included in the normal pixel because a driver which is provided in the defective pixel to drive the two OLEDs is not normally driven, determining whether the input image data is input image data corresponding to the normal pixel.

2. The method of claim 1, wherein the generating of the compensation image data comprises increasing a gray scale of the input image data corresponding to the normal pixel by using the compensation value to generate the compensation image data.

3. The method of claim 1, wherein the determining comprises, when an OLED which is not normally driven among the two OLEDs included in the defective pixel is repaired to be isolated from a driver included in the defective pixel for driving the two OLEDs, determining whether the input image data is input image data corresponding to the defective pixel.

4. The method of claim 3, wherein the generating of the compensation image data comprises decreasing a gray scale of the input image data corresponding to the defective pixel by using the compensation value to generate the compensation image data.

5. The method of claim 1, wherein the determining comprises, when an OLED which is normally driven among the two OLEDs included in the defective pixel is repaired to be connected to a driver for driving the two OLEDs included in the normal pixel, determining whether the input image data is input image data corresponding to the defective pixel.

6. The method of claim 5, wherein the generating of the compensation image data comprises increasing a gray scale of the input image data corresponding to the normal pixel by using the compensation value to generate the compensation image data.

7. The method of claim 1, wherein the generating of the compensation image data comprises changing a gray scale of the input image data to generate the compensation image data, based on the compensation value which is set as a certain value for the defective pixel or the normal pixel.

8. The method of claim 1, wherein the generating of the compensation image data comprises:

calculating the compensation value, based on a gray scale of the input image data, a position of a horizontal line where the defective pixel occurs in the panel, or a color corresponding to the input image data; and changing the gray scale of the input image data to generate the compensation image data, based on the calculated compensation value.

9. The method of claim 1, wherein the generating of the compensation image data comprises:

calculating the compensation value, based on at least two of a gray scale of the input image data, a position of a horizontal line where the defective pixel occurs in the panel, and a color corresponding to the input image data; and changing the gray scale of the input image data to generate the compensation image data, based on the calculated compensation value.

* * * * *